US007658542B2

(12) United States Patent
Risgalla

(10) Patent No.: US 7,658,542 B2
(45) Date of Patent: Feb. 9, 2010

(54) FLEXIBLE LIQUID CONTAINER

(75) Inventor: Eric Risgalla, Geneva (CH)

(73) Assignee: Pakerman S.A., Geneva (CH)

( * ) Notice: Subject to any disclaimer, the term of this patent is extended or adjusted under 35 U.S.C. 154(b) by 610 days.

(21) Appl. No.: 10/551,618

(22) PCT Filed: Mar. 12, 2004

(86) PCT No.: PCT/IB2004/000736

§ 371 (c)(1),
(2), (4) Date: Sep. 30, 2005

(87) PCT Pub. No.: WO2004/087526

PCT Pub. Date: Oct. 14, 2004

(65) Prior Publication Data

US 2006/0182370 A1 Aug. 17, 2006

(30) Foreign Application Priority Data

Apr. 1, 2003 (CH) ..... 0564/03
Dec. 16, 2003 (CH) ..... 2147/03

(51) Int. Cl.
*B65D 30/24* (2006.01)
*B65D 33/00* (2006.01)

(52) U.S. Cl. ..... 383/44; 383/200; 383/906

(58) Field of Classification Search ..... 383/43, 383/44, 3, 906, 200; 222/92
See application file for complete search history.

(56) References Cited

U.S. PATENT DOCUMENTS 2,541,674 A * 2/1951 Snyder ..... 383/209
RE24,251 E * 12/1956 Kaplan et al. ..... 222/107
2,976,988 A * 3/1961 Schneider ..... 206/445
3,009,498 A * 11/1961 Fohr ..... 383/44
3,149,772 A * 9/1964 Olsson ..... 383/103
3,403,715 A * 10/1968 Trudel ..... 604/317
3,637,132 A 1/1972 Gray
3,815,794 A * 6/1974 Carlisle ..... 222/491

(Continued)

FOREIGN PATENT DOCUMENTS

FR 2573391 A1 * 5/1986

(Continued)

*Primary Examiner*—Jes F Pascua
(74) *Attorney, Agent, or Firm*—Baker & Daniels LLP

(57) ABSTRACT

A flexible container (1) for holding a liquid including two walls (10, 11) made of a flexible material, the free overlaying edges of said walls being assembled together by a weld or an adhesive seam (12), so as to define an inner sealed volume of said container, the two said walls also defining a spout (13) designed to protrude outwards from a peripheral portion of the container, and an outflow channel (130) connecting said spout with said inner volume of said container, characterized in that one or several obstacles (14, 14') formed by welding or bonding together the two walls is or are located in said inner volume substantially opposite and in the vicinity of the channel (130) leading to the spout (13) in such a manner as to limit the section of the passage available for the liquid between the inner volume and the outflow channel, while leaving open at least one narrowed passage (140, 141, 146) and in such a manner that a portion of the surface including the spout is deflected, this portion of the surface being substantially defined by the obstacle or the obstacles and by folds directed substantially transversally (142, 143) with respect to said obstacles.

8 Claims, 4 Drawing Sheets

U.S. PATENT DOCUMENTS

| | | | | | |
|---|---|---|---|---|---|
| 3,878,977 | A | * | 4/1975 | Carlisle | 222/491 |
| 4,252,257 | A | * | 2/1981 | Herzig | 222/213 |
| 4,449,243 | A | * | 5/1984 | Platel | 383/103 |
| 4,759,472 | A | * | 7/1988 | Strenger | 222/92 |
| 4,793,121 | A | | 12/1988 | Jamison | |
| 4,952,068 | A | * | 8/1990 | Flint | 366/337 |
| 4,974,732 | A | * | 12/1990 | Sullivan et al. | 222/541.6 |
| 4,988,016 | A | | 1/1991 | Hawkins et al. | |
| 5,195,658 | A | * | 3/1993 | Hoshino | 222/92 |
| 5,373,966 | A | | 12/1994 | O'Reilly et al. | |
| 5,411,178 | A | | 5/1995 | Roders et al. | |
| 5,761,884 | A | | 6/1998 | Tobolka | |
| 5,800,062 | A | * | 9/1998 | Tobolka | 383/104 |
| 6,174,083 | B1 | | 1/2001 | Delefortrie et al. | |
| 6,244,468 | B1 | | 6/2001 | Farmer et al. | |
| D488,375 | S | * | 4/2004 | Risgalla | D9/696 |
| 6,776,307 | B1 | * | 8/2004 | Hagihara | 222/107 |
| D505,081 | S | * | 5/2005 | Risgalla | D9/707 |
| D505,861 | S | * | 6/2005 | Risgalla | D9/696 |
| 6,932,241 | B2 | * | 8/2005 | Hagihara | 222/92 |
| D509,751 | S | * | 9/2005 | Risgalla | D9/707 |
| D523,758 | S | * | 6/2006 | Risgalla | D9/707 |
| D525,144 | S | * | 7/2006 | Risgalla | D9/707 |
| 2004/0096127 | A1 | * | 5/2004 | Rosn | 383/44 |

FOREIGN PATENT DOCUMENTS

| | | | | |
|---|---|---|---|---|
| JP | 6127553 | A | | 5/1994 |
| JP | 06312753 | A | * | 11/1994 |
| JP | 7040116 | A | | 2/1995 |
| JP | 7041017 | A | | 2/1995 |
| JP | 7041019 | A | | 2/1995 |
| JP | 2000025797 | A | | 1/2000 |
| JP | 2000043902 | A | | 2/2000 |
| JP | 2000128193 | A | | 5/2000 |
| JP | 2000142735 | A | | 5/2000 |
| JP | 2002160744 | | | 6/2002 |
| JP | 2003104400 | A | | 4/2003 |
| JP | 2003165550 | A | | 6/2003 |
| WO | WO 98/01361 | | | 1/1998 |
| WO | WO 99/03753 | | | 1/1999 |
| WO | WO 2004/048217 | A1 | | 6/2004 |

* cited by examiner

FLEXIBLE LIQUID CONTAINER

The present invention relates to a flexible container for a liquid, provided with a self-sealing pouring spout.

Flexible containers for holding a beverage or some other liquid offer several advantages over rigid containers and, more particularly: their low cost of manufacture, the use of a minimal amount of material and a small bulk after use. However, once opened and if no rigid pouring spout is provided, either separate or welded/bonded to the flexible sheets of the container, they cannot be easily closed once opened and they tend to allow the liquid to escape. Once the container is opened, the user must hold the container to prevent the liquid from being involuntarily spilled and he cannot leave it to stand on a table or on some other surface, unless it is completely empty.

Various flexible containers with a self-sealing spout have been suggested for overcoming this problem. Generally, either an increase in the resistance to the flow of the liquid is suggested by providing the containers with long thin channels in fluid communication with the spout developing a high resistance to flow, as described in the GB patent 769 810 and the U.S. Pat. No. 4,988,016, or a narrowing or some other obstacle in the vicinity of the spout developing a strong resistance to the flow of the liquid, such as described in the U.S. Pat. No. 5,411,178.

In the U.S. Pat. No. 4,988,016 and in the GB patent 769 810, the self-sealing effect depends mainly on the elasticity characteristics of the material of which the container is made, on the dimensions of the spout as well as on the characteristics of the liquid. In those systems which rely on a strong local resistance, such as those described in the U.S. Pat. No. 5,411,178, the self-sealing effect is strongly dependant upon the dimensions of the passage as well as on the characteristics of the liquid and in particular on its surface tension. In all the prior solutions, the self-sealing effect is strongly dependent on the characteristics of the liquid and/or on the properties of the material of the flexible container and a given spout geometry can often be used only for a specific liquid, owing to the fact that the self-sealing effect is affected by variations in the dimensions of the channel or of the restriction. Another important disadvantage of these systems is that, in order to achieve a reliable self-sealing effect, it is necessary to have a high resistance in the outflow channel which limits strongly the flow rate and necessitates that a considerable compressive force be applied by the user to empty the container. Furthermore, after a first use of the container, the self-sealing effect tends to subside, which results in involuntary leaks.

The same holds true for the container described in the patent application WO 98/01361 which discloses the use of spouts which are shaped differently depending on the liquid held in the container.

Other known sealing means rely on the formation of folds after use by the user, such as described in the U.S. Pat. Nos. 3,278,085, 5,228,782 and 6,244,468. These solutions have the drawback of not providing a self-sealing effect and of requiring an intervention by the user.

Accordingly, an objective of the invention is to provide a flexible container for a liquid, with a self-sealing spout, which is improved by comparison with those already known.

Preferably, the self-sealing effect depends only little on the properties of the liquid held in the container, it is reliable and it allows an outflow without requiring an excessive pressure by the user.

Preferably, the pouring spout of the container has a form, which is simple and easily manufactured, using a minimal amount of material and at a minimal cost.

In order to achieve the objectives of the invention, a flexible container is provided, which has the characteristic features set out in claim 1. Specific embodiments are described in the dependant claims.

A specific embodiment is described hereafter, with reference to the appended drawing, including figures, in which.

Figure 1:
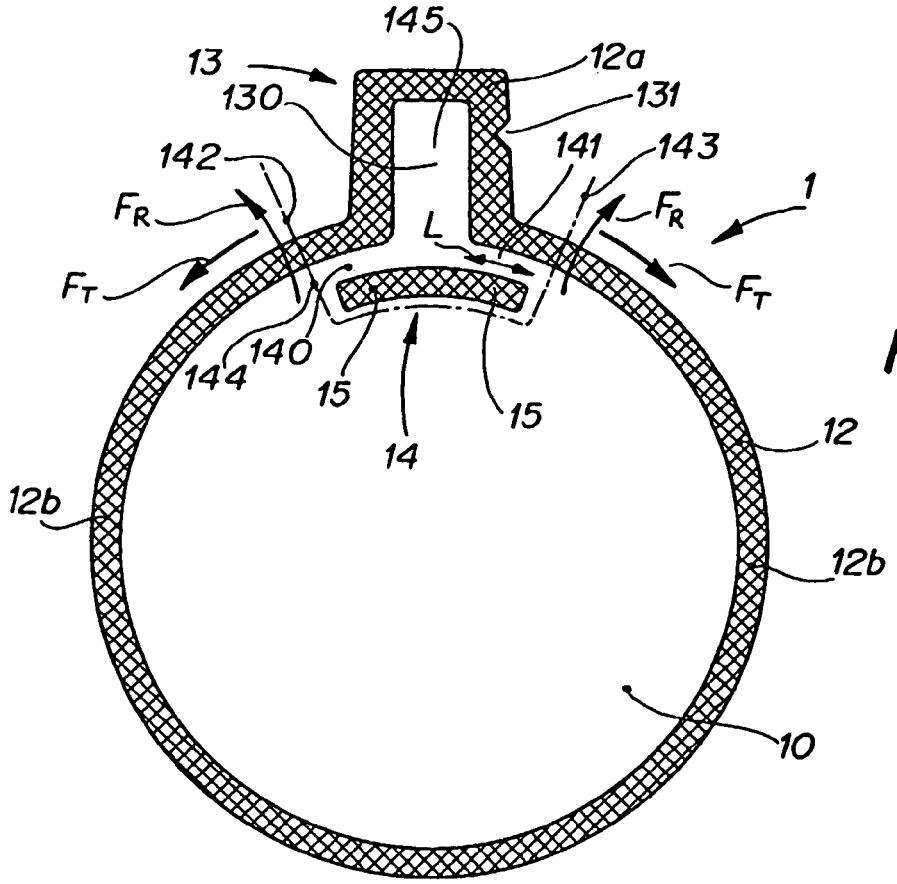
FIG. 1 is a top view of the container according to the invention.

The container 1 illustrated in the figures is made from two sheets 10, 11 of a flexible material, which have the same shape and the same dimensions, and which are fixed together by a weld seam or an adhesive seam 12 running along the periphery of the container 1. In addition to running along the periphery of the container proper, the assemblage seam provided as a weld seam 12 also surrounds a spout 13, protruding from a portion of the periphery of the container. Thus, the spout 13 is made from the same sheets of flexible material as those forming the container 1 and it includes an outflow channel 130 opening inside the flexible container 1. Furthermore, the spout 13 can include a weakening groove 131, which makes it possible to tear off a portion thereof, thus opening the spout 13 and the channel 130.

Inside the flexible container 1, in the vicinity of the location where the channel 130 opens inside the flexible container, the two flexible sheets 10 and 11, made from a polymer or from some other flexible material, are welded or bonded together in such a manner as to form an obstacle 14 located facing the outflow channel. The welded obstacle 14 has an elongated shape and extends between two ends 15 which overlap the peripheral weld 12 on both sides of the outflow channel, while leaving free two passages 140, 141 in the direction of the channel 130. The length L of the overlap is relatively small, compared with the overall length of the peripheral weld 12 and it corresponds, preferably, to less than 10% thereof. Preferably, the longitudinal obstacle runs substantially parallel to the portions of the peripheral weld 12 on the two sides of the outflow channel and approximately perpendicularly to the general direction of the protruding spout.

Figure 2:
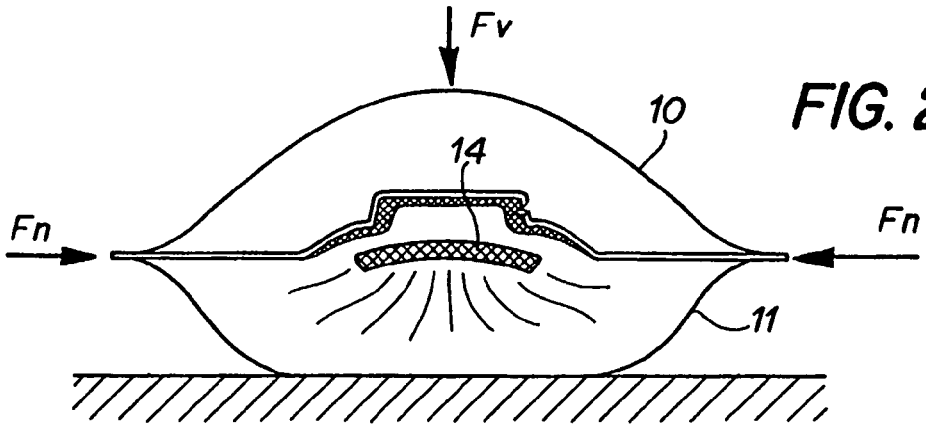
FIG. 2 is a front view of the container of the previous figure placed on a flat surface.
Figure 3:
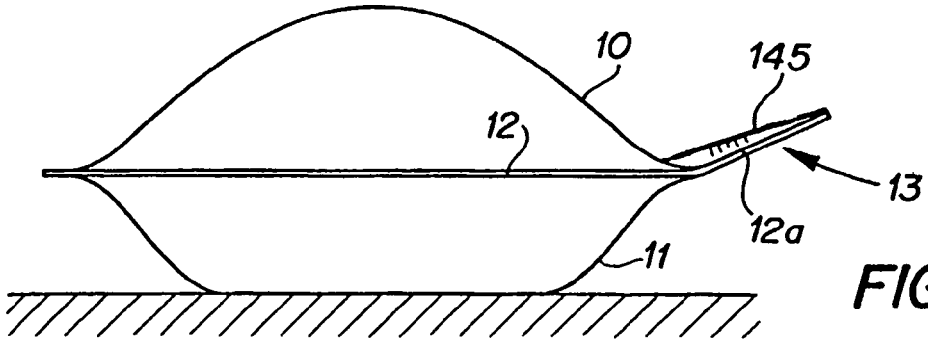
FIG. 3 is a side view of the same container placed on a flat surface.

When the container 1 is filled via a filling spout (not illustrated) and sealed permanently after the filling, the large central parts of the two walls 10 and 11 forming the container 1 move away from each other as the container swells, as can be seen in FIGS. 2 and 3.

When the container 1 is filled and the walls 10 and 11 are, accordingly, pushed away from each other, two folds are formed on each one of the walls 10 and 11, extending transversally with respect to the narrowed passages 140 and 141, approximately along the axes 142 and 143 shown in FIG. 1. The deformation of the walls 10 and 11 in the vicinity of the ends of the obstacle 14—namely of two portions of each wall 10 and 11, which adjoin the two sides of the narrowed passages 140 and 141 and which are prevented from moving away from each other—creates a fold approximately along the axes 142 and 143.

The folds 142, 143, as well as the generally elongated obstacle 15, define along approximately the dotted nip line 144, shown in FIG. 1, with the section 12*a* of the seam extending between the fold lines 142, 143 a portion of the surface, which tends to curve (deflect) as illustrated in FIGS. 2 and 3. The deflection of the area 145 including the spout, between the folds 142, 143, results in the two flexible sheets in this area being urged against each other and thus forming a valve which prevents the flow of liquid through the passages 140, 141 and via the orifice of the protruding spout 130.

When the flexible container is laid on a flat surface as illustrated in FIGS. 2 and 3 and a vertical force $F_v$ is applied approximately on the large central part of the upper wall 10, the folds 142, 143 and the deflection of the central deflection area 145 tend to reinforce, thus increasing the tightness of the valve.

This reinforcement of the folds 142, 143 in the vicinity of the passages 140, 141, as well as the increase in the deflection of the area 143 which increases with the application of a force Fv which is substantially perpendicular to the plane of the flexible sheets are extremely advantageous, since they prevent effectively the escape of liquid when the flexible container is laid in its natural position on a surface which is substantially flat, even when another object, which increases the pressure in the container, is placed on top of the container.

It is to be noted, that the deflection of the area 145 is non symmetrical, since the area 145 is deflected on one side or on the other side of the container. The deflection is a consequence of the particular geometry of the obstacle 15 which is either welded or bonded, and of its position with respect to the protruding spout portion 130 and the seam portion 12*a*, which, together, determine the formation of the folds 142, 143. In particular, the folds 142 and 143, as well as the obstacle 15, define a nip line 144 between the two flexible sheets. This line is not straight, but has a generally curved shape of which the ends cut across the peripheral seam. This nip line about the protruding spout, which is not straight, makes it possible to cause the deflection of the spout area 145.

In order to enable the liquid to flow via the spout 13, the user simply needs to exert a certain pressure on the container, in particular by pressing the container at least partly along a direction $F_h$, which is substantially perpendicular to the plane of the weld of the obstacle 14, thus opening the lips closing the narrowed passage or passages 140, 141. The interruption of this compressive action closes the narrowed passages and closes the container.

The exertion of a compressive force on the container in the direction $F_H$, i. e. substantially perpendicularly to the plane of the weld of the obstacle results in a decrease of the deflection and of the effect of the folds 142, 143, accompanied by an increased pressure of the liquid in the container which opens slightly the lips of the sheets at the entrance to the passages 141, 140, to enable an outflow of the liquid. In fact, when a compressive force $F_H$ is applied approximately on the lateral sections 12*b* of the seam, which is accompanied by an increase of the pressure inside the container, a pulling force $F_T$ and a torque $F_R$ act on the portion of the seam in the vicinity of the spout which tends to flatten, i. e. to reduce the deflection of the spout area 145.

Owing to the fact that the narrowed passages 140, 141 have a length which is very small and a geometry which is very simple, the effectiveness of the sealing does not depend as strongly on the properties of the liquid and the elasticity of the material of the packaging as in known flexible containers. Furthermore, considering that the protruding spout 13 is not required to have a particular shape, the same can be very compact and simple, for example be straight as in the example illustrated in the figures, which facilitates its manufacture and its use and reduces the amount of material needed. Another advantage is that the shape of the weld for creating the obstacle is very simple and, accordingly, it can be formed rapidly and at a low cost on industrial machines used for making packaging items, in the same operation as that carried out for forming the peripheral weld seam.

Also, a given flexible packaging can contain any type of liquid, the only limitation being the chemical compatibility of the liquid with the material forming the container.

Figure 6:
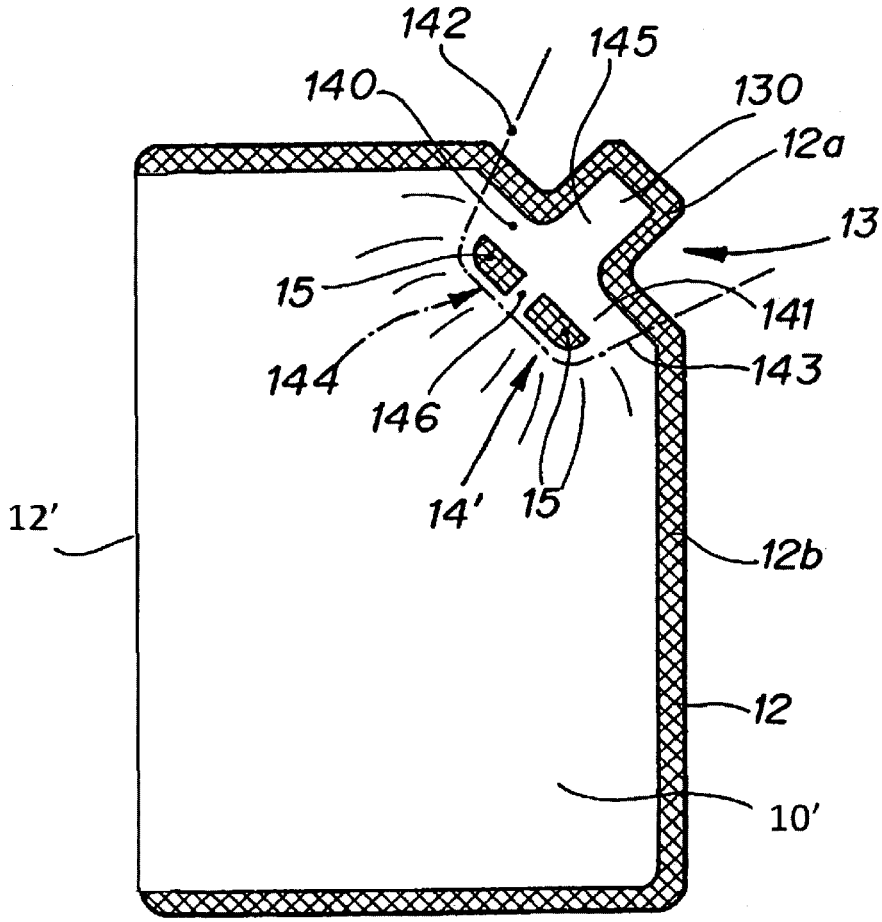
FIG. 6 is a top view of a container according to another embodiment of the invention.
Figure 7:
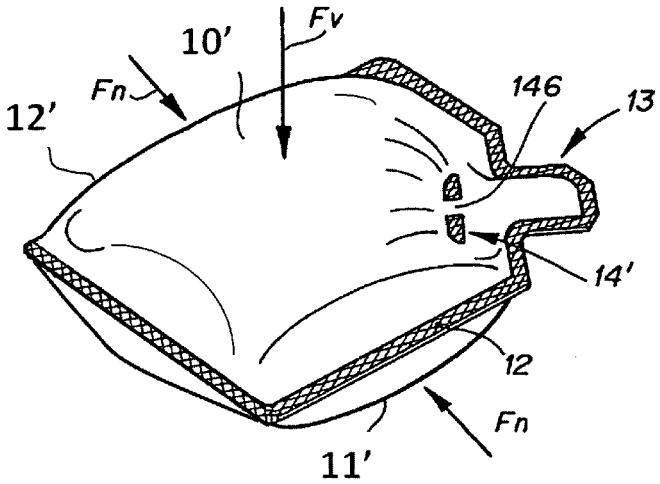
FIG. 7 is a perspective view of the container according to FIG. 6.

The figures show a container 1 having a substantially circular shape; it is however understood, that this container can assume any shape adapted to its use. In the case of a container of a design having one side with a straight edge, the container can be formed from a single sheet of a flexible material folded over along this straight edge, with the remaining edges being welded together to form the container. For example, and as shown in FIGS. 6 and 7, a container according to the invention is shown wherein the walls 10', 11' of the container are made from a single sheet of flexible material which is folded (along 12') to form two overlying walls 10', 11'.

Furthermore, the embodiment of the flexible container illustrated and described has an obstacle 14 defining two narrowed passages 140 and 141. One could also have one end of the obstacle 14 in contact with the neighbouring portion of the weld 12, thus leaving only one narrowed passage, with a single fold being then formed on the walls 10 and 11 upon the filling of the container.

Figure 4:
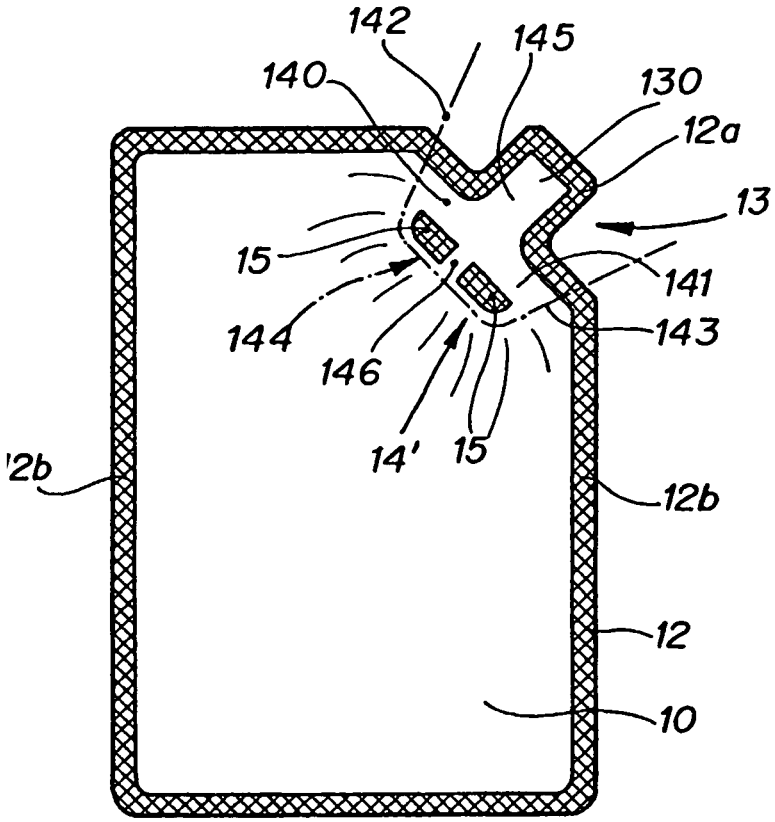
FIG. 4 is a top view of a container according to a second embodiment of the invention.
Figure 5:
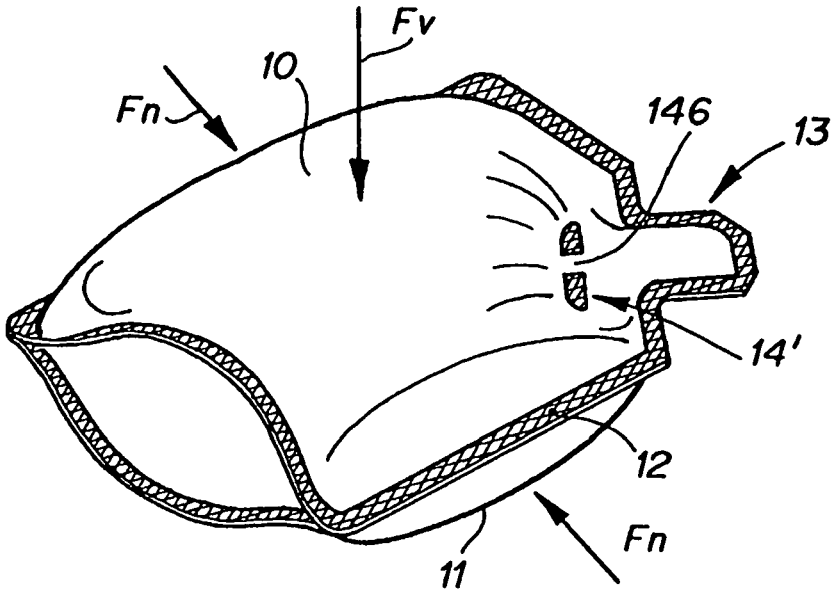
FIG. 5 is a perspective view of the second embodiment.

In another embodiment, such as that illustrated in FIGS. 4 and 5, the container has a shape, which is substantially rectangular, and the spout 13 is positioned in a corner of the rectangle to protrude in a direction along an oblique axis approximately along the median line between the edges of the adjoining rectangle. In this embodiment, a welded obstacle 14' is arranged facing the spout as in the previous embodiments, except that this obstacle is provided with a central passage 146. In this embodiment, the deflection of the spout area 145 defined by the nip line 144 is substantially the same as in the case of the embodiment described previously. However, because of the rectangular shape of the container and of the position of the spout in a corner thereof, a compressive force applied by the user to the central part of opposite edges 12*b* of the container creates a pulling force and a torque which are less pronounced on the spout area 145 by comparison with the embodiment described previously. However, owing to the rectangular shape of the container and of the position of the spout in one corner thereof, a compressive force exerted by the user upon the central part of the opposite edges 12*b* of the container generates a pulling force and a torque which are less pronounced on the spout area 145 than in the embodiment described previously.

In the case of such elongated shapes in which the compressive force is exerted on the container at a relatively long distance from the spout and where the spout is in a non symmetrical position of the container with respect to the compressive forces applied to the container, the central passage 146 provided in the welded obstacle makes it possible to initiate and facilitate the flow of liquid in the passage of the spout.

The invention claimed is:

1. A flexible container for containing a liquid, including two overlaying walls of flexible material welded or bonded along a peripheral seam so as to define an inner sealed volume, said container comprising an outwardly protruding spout and an outflow channel connecting said spout with said inner sealed volume of said container, wherein one or several obstacles formed by welding or bonding together a portion of said two overlaying walls is or are located in said inner sealed volume substantially opposite and in the vicinity of the outflow channel thereby leaving open at least one restricted passage between the inner sealed volume and the outflow channel, the position of the one or several obstacles relative to the spout and the peripheral seam being such that a portion of the overlying walls including the spout and bounded by the obstacle or the obstacles and by folds directed substantially transversally with respect to said obstacles deflects or arches when liquid is present in the inner sealed volume, and wherein the obstacle has an elongated shape and extends between two ends overlapping the peripheral seam on either side of the spout by an amount that is less than 5% of the overall length of the peripheral seam.

2. A flexible container according to claim 1, wherein the obstacle defines two said restricted passages at two opposite sides of the outflow channel of the spout.

3. A flexible container according to claim 1, wherein the spout has a generally straight shape and extends substantially perpendicularly to a peripheral portion of the container to which it is affixed.

4. A flexible container according to claim 1, wherein the spout includes a groove for tearing off a portion of the spout.

5. A flexible container according to claim 1, wherein the walls of the container are made from a single sheet of flexible material, which is folded over to overlay said two walls.

6. A flexible container according to claim 1, wherein the walls of the container are made from two separate sheets of flexible material.

7. A flexible container according to claim 1, wherein the obstacle extends substantially parallel to portions of the peripheral seam located on either side of the spout.

8. A flexible container according to claim 1, comprising at least two said obstacles spaced apart by a narrow passage facing the outflow channel of the spout.

* * * * *

UNITED STATES PATENT AND TRADEMARK OFFICE

CERTIFICATE OF CORRECTION

PATENT NO. : 7,658,542 B2
APPLICATION NO. : 10/551618
DATED : February 9, 2010
INVENTOR(S) : Eric Risgalla It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1104 days.

Signed and Sealed this

Thirtieth Day of November, 2010

David J. Kappos

David J. Kappos
*Director of the United States Patent and Trademark Office*